US008910930B2

(12) United States Patent
Zacche' et al.

(10) Patent No.: US 8,910,930 B2
(45) Date of Patent: Dec. 16, 2014

(54) MACHINE FOR SEPARATING SHEETS OF CARTONS

(71) Applicant: SMI S.p.A, Bergamo (IT)

(72) Inventors: Vanni Zacche', Bergamo (IT); Sergio Musitelli, Bergamo (IT); Marco Paganelli, Bergamo (IT)

(73) Assignee: SMI S.p.A., Bergamo (IT)

( * ) Notice: Subject to any disclaimer, the term of this patent is extended or adjusted under 35 U.S.C. 154(b) by 0 days.

(21) Appl. No.: 13/958,729

(22) Filed: Aug. 5, 2013

(65) Prior Publication Data

US 2014/0035220 A1 Feb. 6, 2014

(30) Foreign Application Priority Data

Aug. 3, 2012 (IT) ..... MI2012A1379

(51) Int. Cl.

| | |
|---|---|
| ***B65H 5/08*** | (2006.01) |
| ***B65B 41/06*** | (2006.01) |
| ***B65H 3/08*** | (2006.01) |
| ***B65H 3/44*** | (2006.01) |
| ***B65H 5/06*** | (2006.01) |

(52) U.S. Cl.

CPC ..... *B65B 41/06* (2013.01); *B65H 3/0866* (2013.01); *B65H 3/443* (2013.01); *B65H 5/062* (2013.01); *B65H 2404/154* (2013.01); *B65H 2701/1764* (2013.01)

USPC ..... 271/11; 271/100; 271/102; 271/106; 271/107

(58) Field of Classification Search

USPC ..... 271/11, 99, 100, 101, 102, 106, 107

See application file for complete search history.

(56) References Cited

U.S. PATENT DOCUMENTS

| | | | |
|---|---|---|---|
| 4,369,962 | A | 1/1983 | Spiro |
| 4,889,331 | A | 12/1989 | Sardella |

FOREIGN PATENT DOCUMENTS

| | | | |
|---|---|---|---|
| FR | 2 654 084 | A1 | 5/1991 |
| GB | 1 437 749 | A | 6/1976 |
| GB | 2 290 074 | A | 12/1995 |

*Primary Examiner* — David H Bollinger

(74) *Attorney, Agent, or Firm* — Dickstein Shapiro LLP

(57) ABSTRACT

A sheet separator machine for cartons for packaging from a warehouse, typically a well warehouse, in which the cartons are stacked. More particularly, a machine for separating sheets of cartons. The machine includes a frame on which a handling station of the cartons, a warehouse for at least one stack of cartons, and a gripping station of the cartons, are mounted, in an operatively contiguous position. The gripping station includes a pair of counter-rotating motorized rolls for withdrawing a carton from the stack of cartons.

20 Claims, 10 Drawing Sheets

MACHINE FOR SEPARATING SHEETS OF CARTONS

FIELD OF THE INVENTION

The present invention relates to the field of the packaging of objects, such as, for example bottles or other containers. Particularly, the invention relates to a machine for separating sheets of cartons for packaging from a warehouse, typically a well warehouse, in which the cartons are stacked.

DESCRIPTION OF THE RELATED ART

In the object packaging line, particularly for bottles or similar containers, various techniques and different types of packaging are used. For example, bottles may be wrapped by a resistant plastic film, typically used for six-bottle packs, or, in cases of pallet having larger dimensions, they may be arranged in a carton tray that will be finally coated, together with the bottles, by a plastic film. In other types of packaging, the bottles are wrapped by a carton band (three or six small-sized bottles) or closed in carton boxes.

Both in the case of manufacturing carton trays and boxes, the packaging machine receives the carton sheets from a warehouse, from which the cartons have to be singularized and withdrawn before being sent to the packaging machine.

In some machines of the prior art, handling of the carton sheets from the warehouse to the transport means, which send them to the packaging machine is carried out automatically by a sucker system that lifts the single carton from the carton stack, translate it above the transport means, and drops it thereupon. Therefore, this system implements a rather complex movement, implying a poor productivity.

In other cases, the stack of cartons is compressed downwardly against a conveyor belt, so that the latter separates the lowermost carton and sends it directly to the packaging machine. However, neither this system is very efficient, moreover when the cartons have smooth surfaces, such that they exert a poor friction on the conveyor belt surface. In these cases, it is likely that the process of separating the cartons into sheets is discontinuous, resulting in a disturbance of the successive packaging stage.

Another problem that is created when it is necessary to change the type of cartons is to empty the warehouse from the cartons with the old size. This operation is often carried out by hand.

SUMMARY OF THE INVENTION

The problem faced by the present invention is to provide a machine for separating carton sheets that allows overcoming the drawbacks set forth above.

Such a problem is solved by a machine for separating sheets of cartons as set forth in the appended claims, the definitions of which are an integral part of the present description.

Further characteristics and advantages of the present invention will be more clearly understood from the description of some implementation examples, given herein below by way of illustrative, non-limiting example.

DETAILED DESCRIPTION OF THE INVENTION

With reference to the figures, the machine for separating cartons into sheets, generally indicated by the number 1, comprises a frame 2 on which, in an operatively contiguous position, a handling station 3 of the cartons C, a warehouse 4 for the cartons C, and a gripping station S of the cartons C are mounted.

Figure 1:
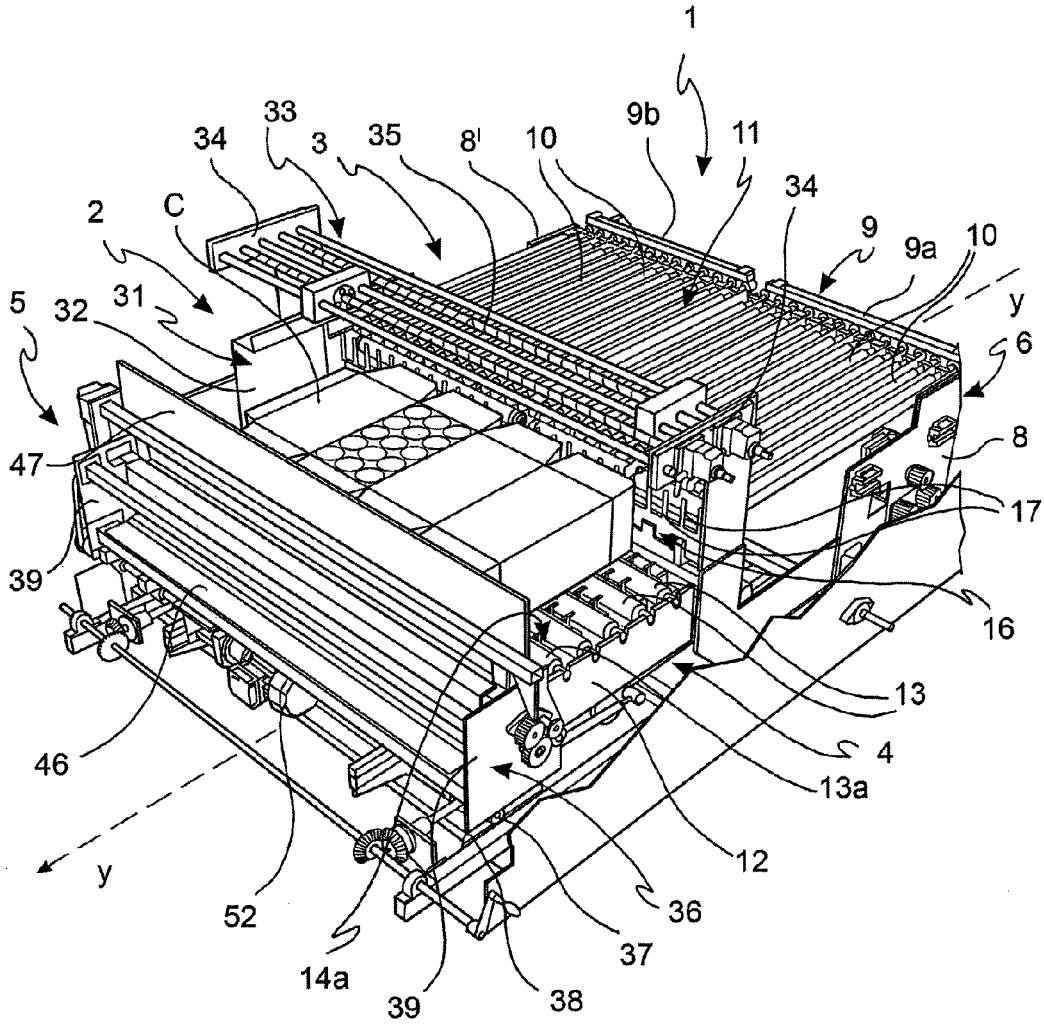
FIG. 1 represents a perspective view of the machine of the invention.
Figure 1A:
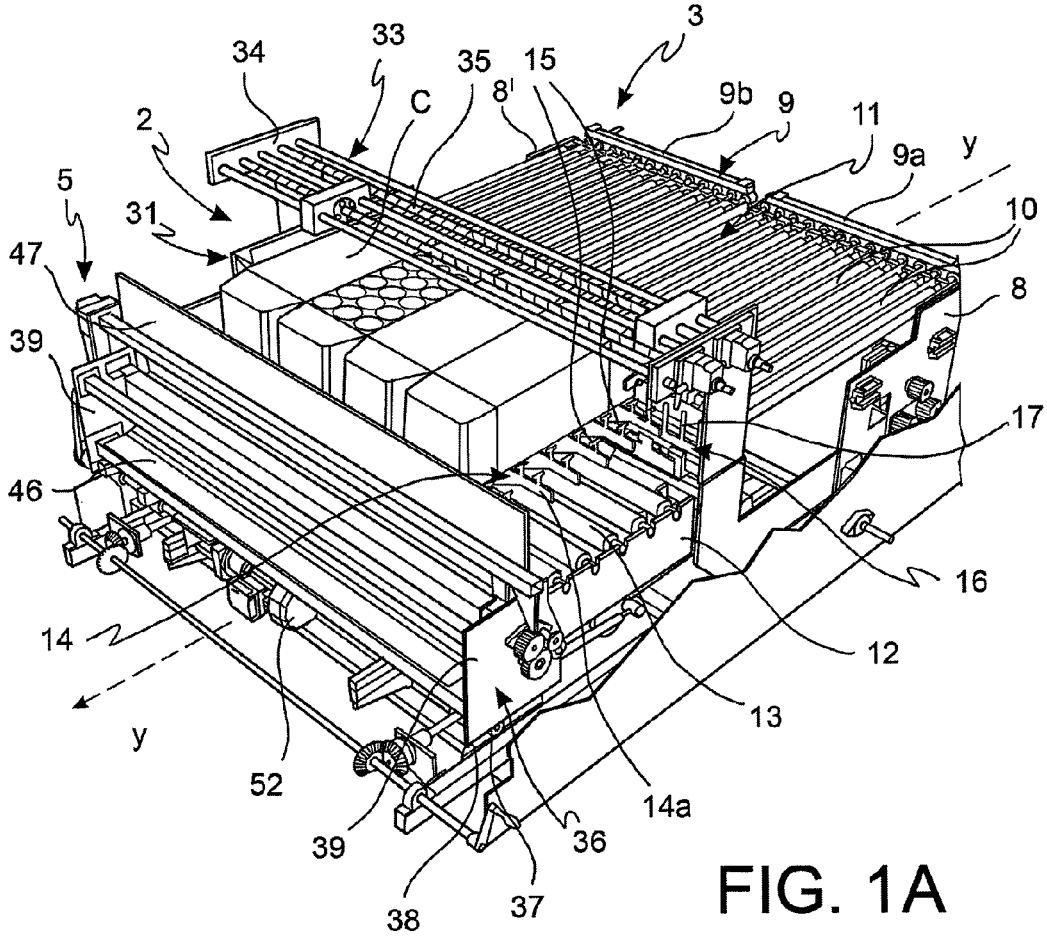
FIG. 1A represents a perspective view of the machine of FIG. 1 in a different operative condition.

The frame 2 extends along a main axis Y forming the handling direction of the cartons C, according to the arrow indicated in FIG. 1.

The handling station 3 is arranged upstream along the handling direction of the cartons and comprises a mobile cart 6 along the axis Y. The cart 6 slides along special guides 7 (see FIG. 5B), and it is moved by an actuator (not shown), such as a rotary motor or an electric, pneumatic, or hydraulic linear actuator.

Figure 1B:
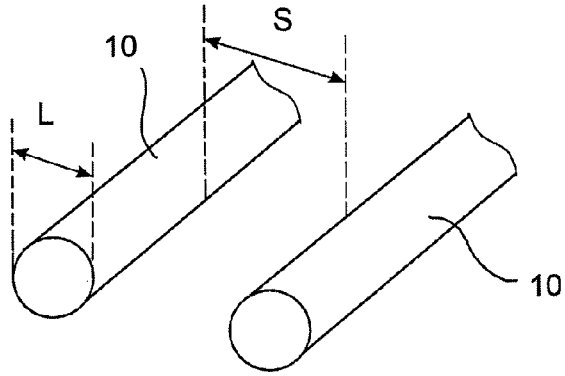
FIG. 1B represents a perspective view of a detail of the machine of FIG. 1.

The cart 6 comprises two side edges 8, 8'—comprising sliding means suitable to slide on the guides 7—and a bottom frame 9 joining the two side edges 8, 8'. From the bottom frame 9, a plurality of rods 10 extends, which are arranged parallel to the axis Y, such as to compose on the whole a fork member 11. The rods 10 are spaced apart one from another by a space S, and have a width L (FIG. 1B).

In the embodiment shown in the FIGS. 1, 1A, 4, and 5A-5C, the bottom frame 9 is divided into two independent sections 9*a*, 9*b*, each of which carries a plurality of rods 10, and it is moved by an independent motorization 50, 50'. In this manner, two fork members 11 are created, which operate in parallel, so as to be able to load two stacks of cartons into the warehouse 4, as needed.

However, in other embodiments, the bottom frame will be a single one, such as for example in machines having lower dimensions.

The warehouse 4 comprises two side edges 12 on which a plurality of rolls 13 is hinged, which are mounted idle and arranged transversally to the axis Y, so as to form a support and sliding surface for the stack of cartons C.

In some embodiments, the roll 13*a* proximate to the gripping station 5—or one or more different rolls 13 of the warehouse 4—is motorized, so as to translate the cartons C towards the gripping station 5. In such a case, such roll 13*a* will be operatively connected to a suitable motorization 51.

The rolls 13 are spaced apart so as to create a gap between a roll and the contiguous one.

Below the warehouse 4, a lifting member 14 for the stack of cartons C is arranged. The lifting member 14 comprises a plurality of bars 14*a* arranged transversally to the axis Y, but offset with respect to the rolls 13, such as to take a position or to be located below the gaps, between a roll and the contiguous one. The number of bars 14*a* may be the same as or different from that of the rolls 13.

Each bar 14*a* supports a plurality of resting members 15, for example, T-shaped members, in which, preferably, the T shape is arranged parallel to the axis Y of the machine. However, other shapes will be able to be provided. In any case, the dimensions of the resting members 15 do not exceed the dimensions of the gap between the rolls 13, so as to be able to pass through it during the operative steps that will be described herein below.

The resting members 15 are arranged in an offset position with respect to the rods 10 of the fork member 11. Furthermore, the gap between a resting member 15 and the contiguous one will be larger than the width L of the rods 10 of the fork member 11, so as not to interfere during the loading and unloading step of the cartons C, which will be described herein below.

The bars 14*a* can be in turn supported on a frame (not shown) arranged at the base thereof, which mutually connects them to form a single member. However, it will be possible, even if less convenient, to keep each bar 14*a* independent from the other ones.

The lifting member 14 is mobile between a retracted position, in which the resting members 15 are located at the same level, or at a lower level with respect to the rolls 13—in such a manner that the stack of cartons C is supported only by the rolls 13, and it may slide thereon—and an extended position, in which the lifting member 14 engages, by the resting members 15, the stack of cartons C and brings them to a lifted position in which the stack of cartons C is not supported by the rolls 13.

The movement of the lifting member 14 is obtained by means of an actuator (not shown), such as a rotary motor or an electric, pneumatic, or hydraulic linear actuator.

Figure 2:
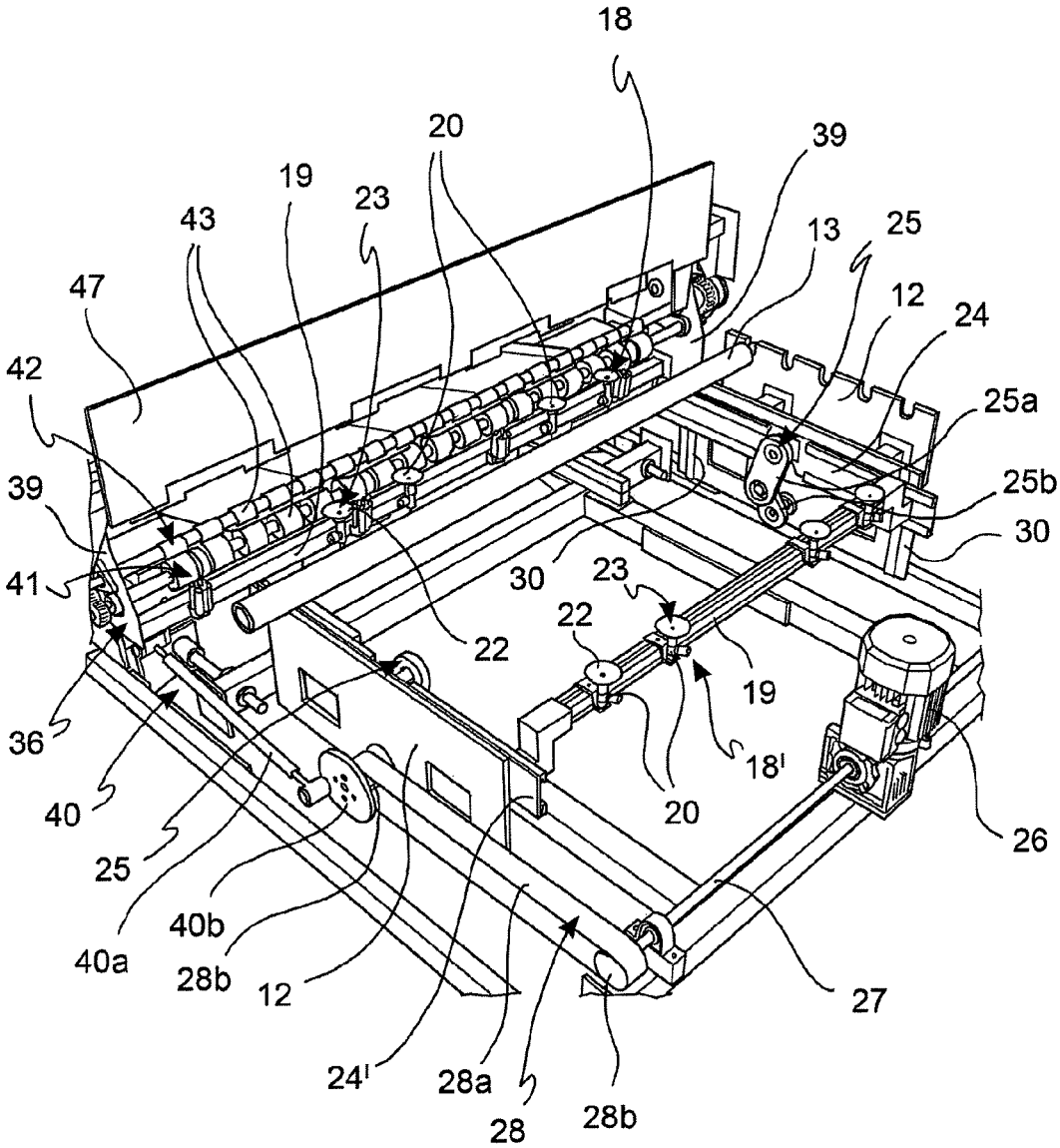
FIG. 2 represents a perspective view of a detail of the machine of FIG. 1.

The sheet separator machine of the invention comprises singularization means of a carton C from the stack of cartons. Particularly, the warehouse 4 comprises sucker means 18, 18' for gripping a carton C from below, from the stack of cartons (FIG. 2).

First sucker means 18 comprise a support bar 19 on which a plurality of suction bells 20 is secured. The support bar 19 extends transversally to the axis Y.

The suction bells 20 comprise a body 21, connected to suction means (not shown), and a sucker member 22 having a central hole 23 in flow communication with the inside of the body 21 and thus with said suction means.

As it will be best described herein below, the function of the sucker means 18 is to promote the separation of the carton C located at the bottom of the carton stack.

To this aim, the first sucker means 18 are positioned immediately downstream of the plurality of rolls 13.

Second sucker means 18', completely similar to the first sucker means 18, can instead be positioned in a suitable position below the rolls 13, such as to cooperate with the first sucker means 18 in separating the carton C from the stack. The arrangement of the second sucker means 18' will be preferred, even if not strictly required, in case of cartons C having large dimensions.

The sucker means 18, 18' are mobile between a lowered position and a lifted position. As it will be best described herein below, the top-to-bottom movement of the sucker means 18, 18' takes place in conjunction with the suctioning of a carton C, and it is responsible for the separation of the latter from the stack.

The support bars 19 of the sucker means 18, 18' are secured at the two ends thereof to corresponding longitudinal bars 24, 24' arranged in the proximity of the inner face of the side edges 12 and slidable vertically on guides 30. The longitudinal bars 24, 24' are connected to corresponding crank mechanisms 25, i.e., a piston rod 25*a*-crank 25*b*-system that, in turn, are operatively connected to a motorization 26.

Particularly, in an embodiment, the motorization comprises a drive shaft 27 that extends transversally with respect to the axis Y of the machine and that is connected by motion transmission means 28—for example, a belts 28*a* and pulleys 28*b* system—to the crank 25*b* of the crank mechanisms 25. In this manner, the motorization 26 allows, by the crank mechanisms 25, lowering or lifting the longitudinal bars 24, and thus the sucker means 18, 18'.

The handling station 3 and the warehouse 4 are adjacent and arranged one after the other one, respectively, along the axis Y. Between the handling station 3 and the warehouse 4, a separator 16 is located. The separator 16 comprises a plurality of teeth 17 facing upwardly and mutually spaced apart by a gap, the width of which is larger than the width L of the rods 10 of the fork member 11. The width of the teeth 17 is further less than that of the gap S between the rods 10 of the fork member 11.

The separator 16 is mobile between a retracted position, in which the upper end of the teeth 17 is located below the upper supporting surface of the rods 10, and an extended position, in which the teeth 17 are inserted between the gaps S of the rods 10 and are lifted above the upper supporting surface of the rods 10.

Also the movement of the separator 16 is obtained by means of an actuator (not shown), such as a rotary motor or an electric, pneumatic, or hydraulic linear actuator.

In an embodiment, shown in FIG. 1, the warehouse comprises containment means 31 for the side containment of the stack of the cartons C. The containment means 31 comprise two plates 32 (only one of which being shown in the Figure) with an undercut profile. The containment means 31 also comprise connection means 33 of the plates 32 that consist in a support structure 34 for each plate 32, said support structures 34 being connected by transversal rods 35. In other embodiments, the containment means 31 can also be omitted.

The gripping station 5 of the cartons C comprises a cart 36 slidable by suitable rollers 37 on a track 38. In an embodiment, the rollers 37 are mounted below the side edges 39 of the cart 36.

The cart 36—and thus the entire gripping station 5—is longitudinally mobile along the axis Y. The cart 36 performs an alternated motion approaching to and moving away from the warehouse 4. To this aim, the cart 36 is connected by suitable motion transmission systems to a motorization.

In the embodiment shown in FIG. 2, the side edges 39 of the cart 36 are connected to corresponding crank mechanisms 40—i.e., a piston rod 40*a*-crank 40*b* system—which in turn are operatively connected to the motorization 26 that performs also the alternated vertical movement of the sucker means 18, 18'. The crank 40*b* is mounted on the same pulley 28*b* receiving the motion through the belt 28*a*.

Motorized rolls 41, 42 connected to a suitable motorization 52 are mounted on the cart 36. The motorized rolls 41, 42 are arranged transversally with respect to the axis Y and in an adjacent position to one another, so that a gap substantially corresponding to the thickness of the carton C to be separated into sheets is created therebetween. The first roll 41 is arranged in a lower and offset position along the axis Y with respect to the second roll 42, such as to be located nearer to the warehouse 4 edge.

Figure 3A:
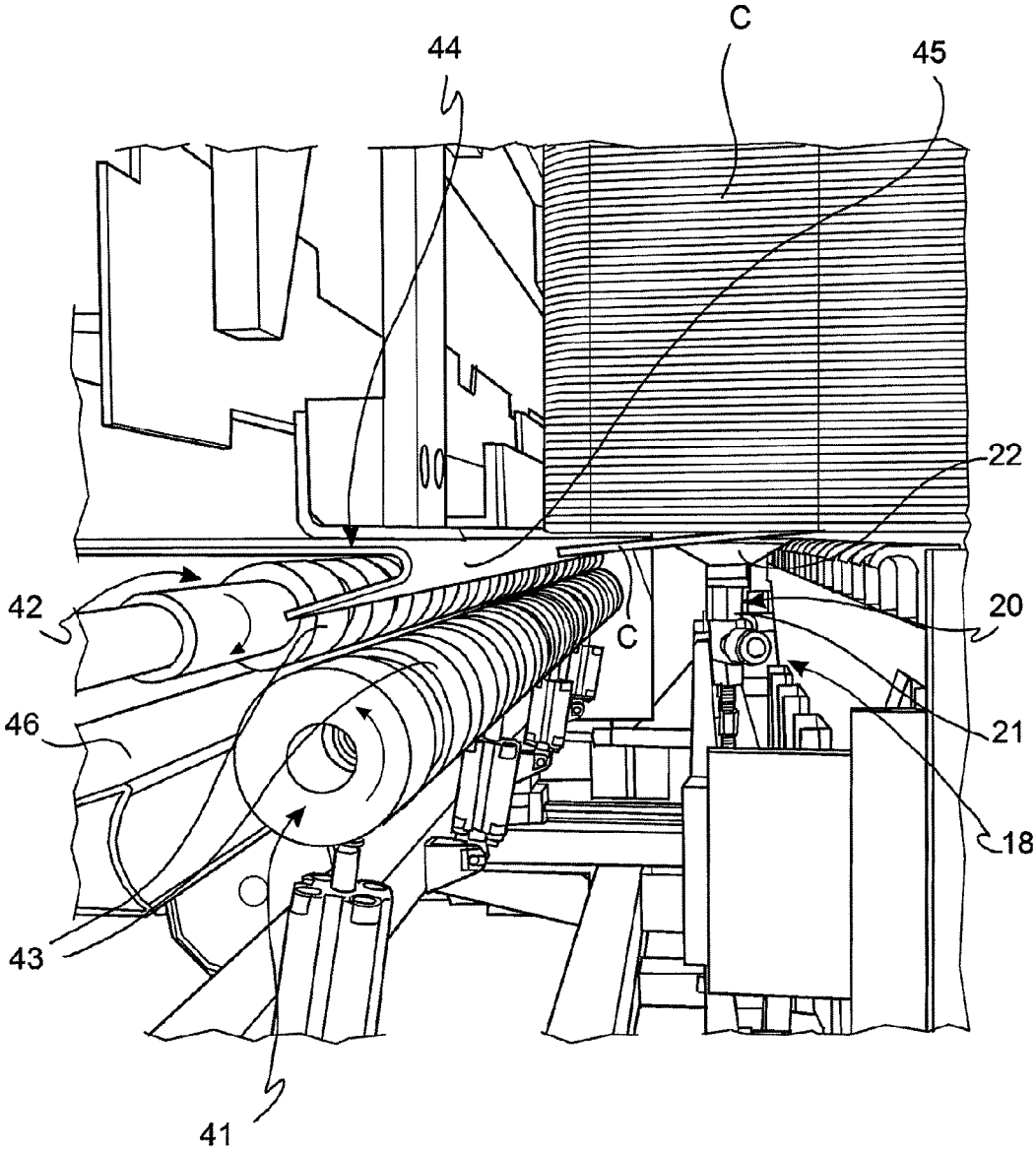
FIGS. 3A, 3B, and 3C represent a perspective view of a detail of the machine of FIG. 1, in three different operative steps.
Figure 3B:
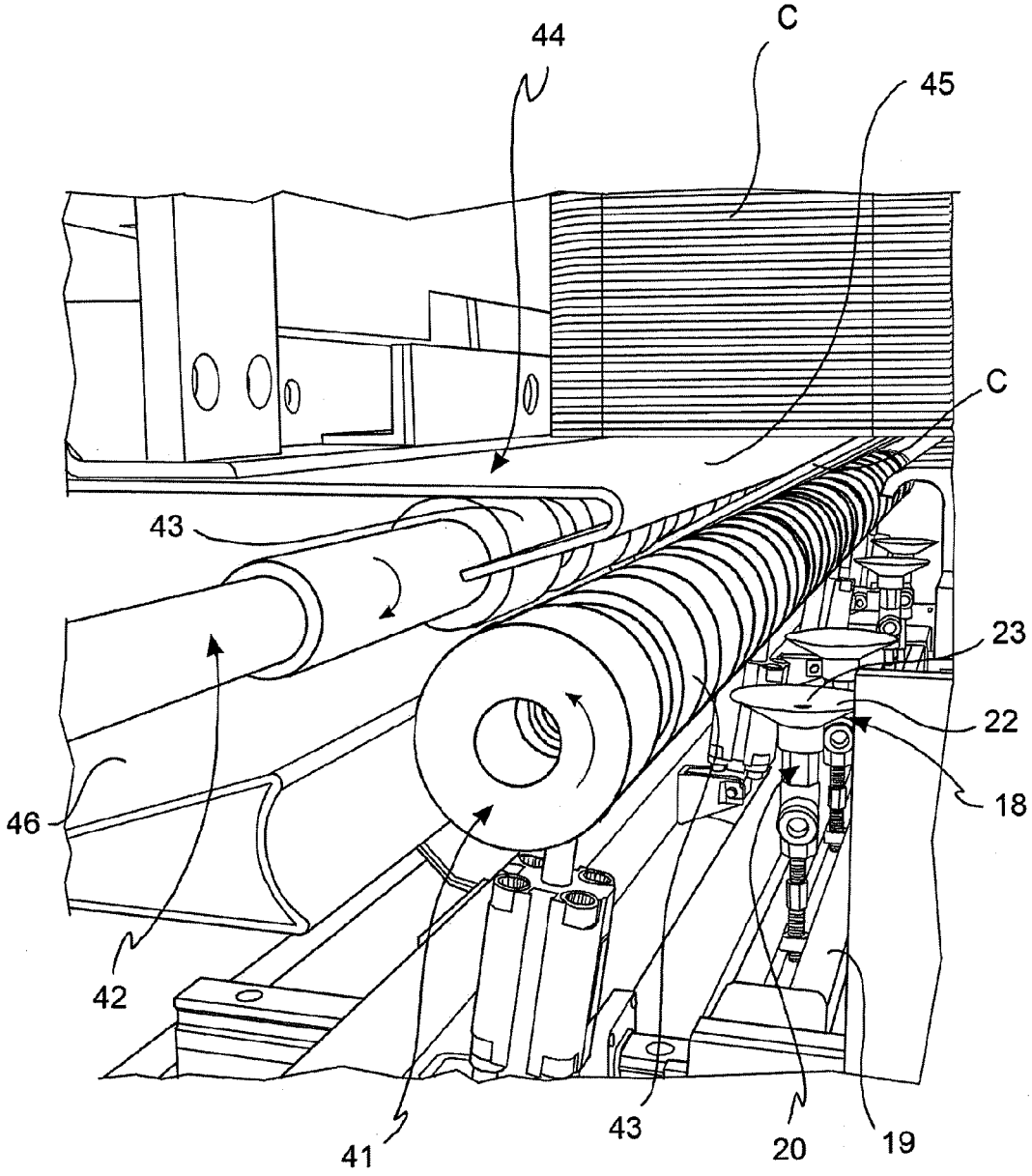
Figure 3C:
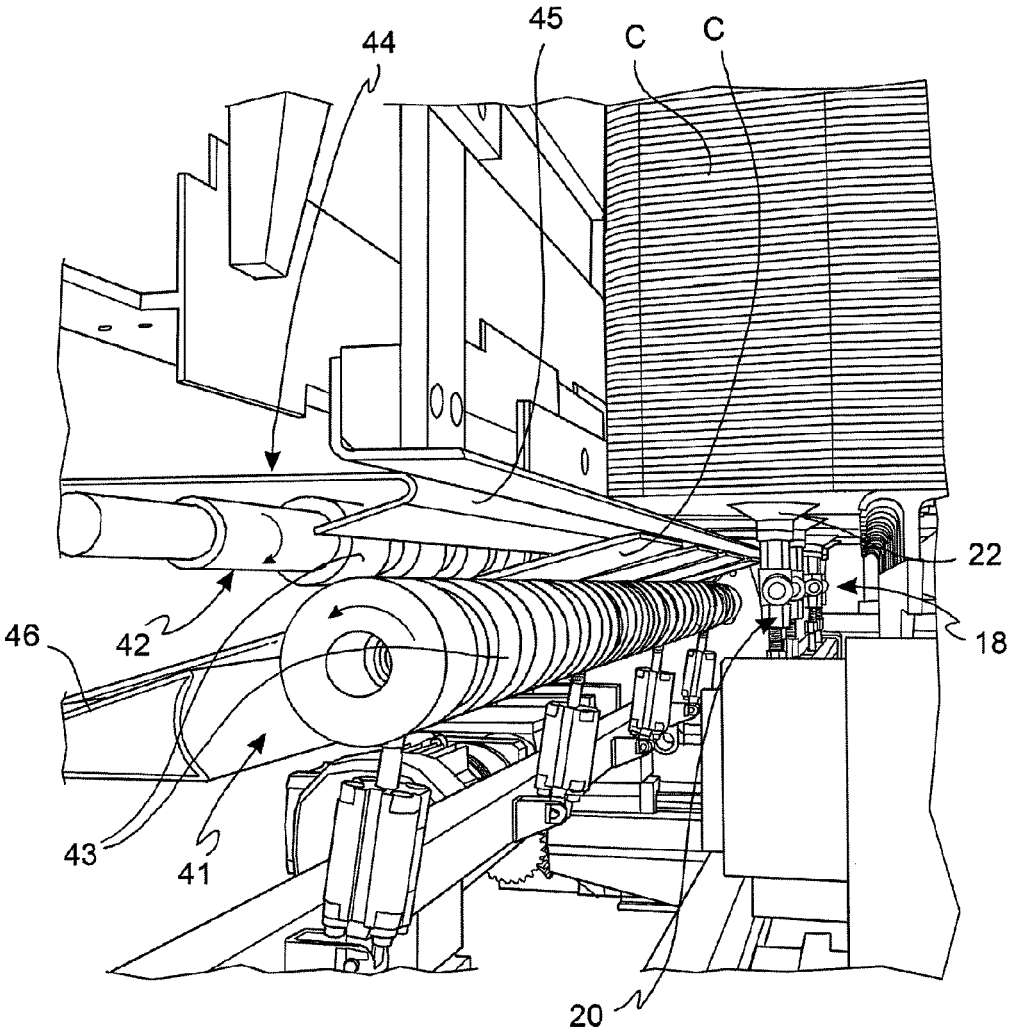

The first roll 41 rotates counter-clockwise, while the second roll 42 rotates clockwise, such as to grip and drag a carton C, as shown in the FIGS. 3B and 3C.

The rolls 41, 42 are gummed. They can be completely coated with an elastic material, such as rubber or synthetic elastomer, or, as shown in the embodiment of the figures, it may have a plurality of gummed bands 43.

Above the rolls 41, 42 and flush with the bottom of the stack of cartons C in the warehouse 4, a separator wedge 44 is located. The separator wedge 44 is composed of a horizontal foil folded downwardly backward so as to create a rounded wedge-shaped profile 45 above the first roll 41.

Downstream of the pair of rolls 41, 42, particularly of the first roll 41, a support surface 46 for the carton C is arranged, which is separated from the machine. Typically, such support surface 46 will end at transport means (not shown) for sending the carton C separated into sheets towards a packaging machine.

Furthermore, a holding edge 47 is secured on the cart 36, the function of which is to hold and level the stack of cartons C present in the warehouse 4. To this aim, the holding edge 47 is located on the upper portion of the side of the cart 36 facing the warehouse 4.

The operation of the machine for separating into sheets according to the invention provides a loading step of the stack of cartons C in the warehouse 4, a step of separating the cartons into sheets, a step of topping up the cartons in the warehouse 4, and optionally a step of unloading the cartons C left in the warehouse 4 (the latter step may be carried out when changing the carton size is desired for a different type of packaging operation).

Figure 5A:
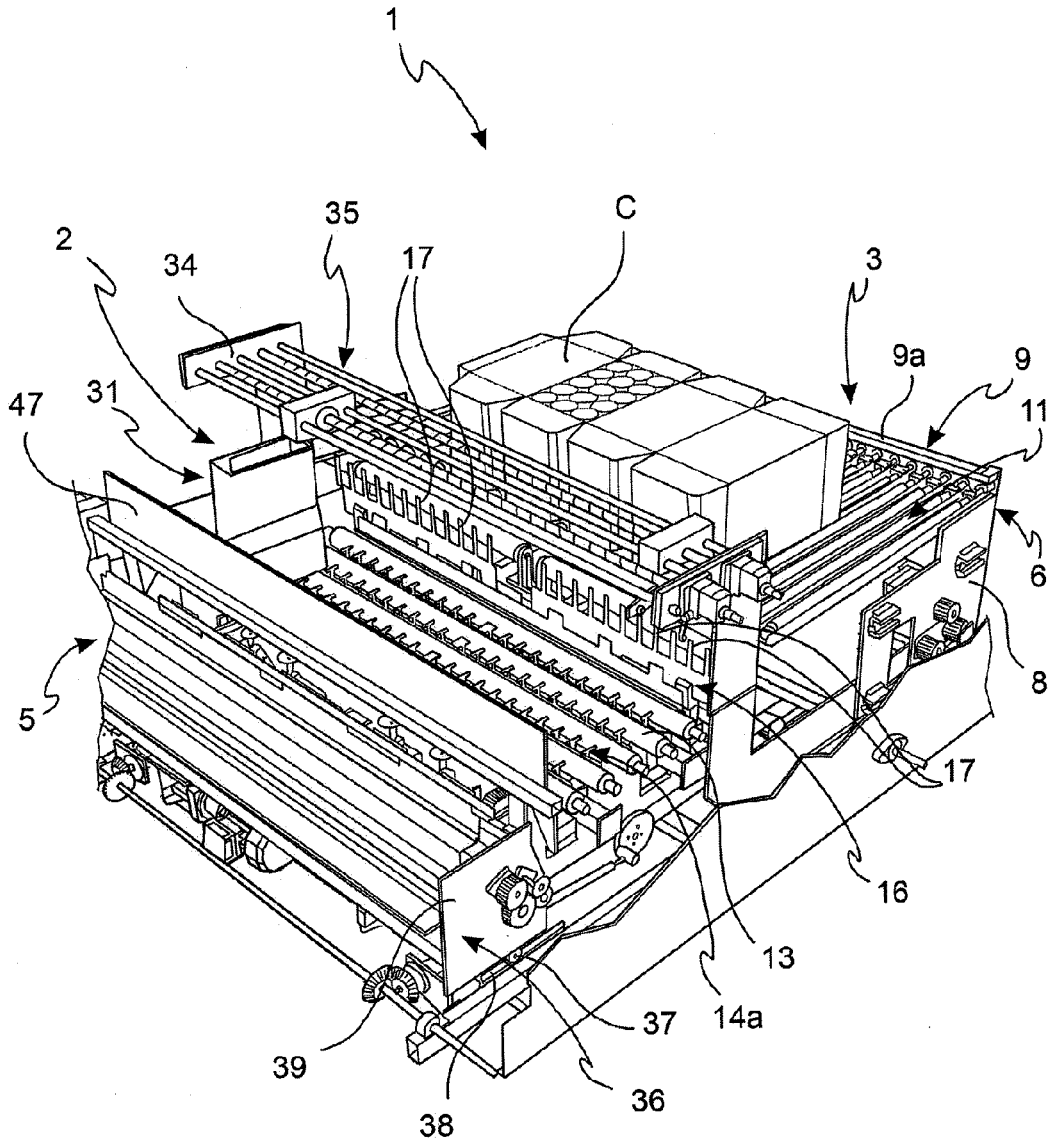
FIGS. 5A, 5B, and 5C represent a perspective view of the machine of FIG. 1 in three different moments of the operative loading step of the cartons.
Figure 5B:
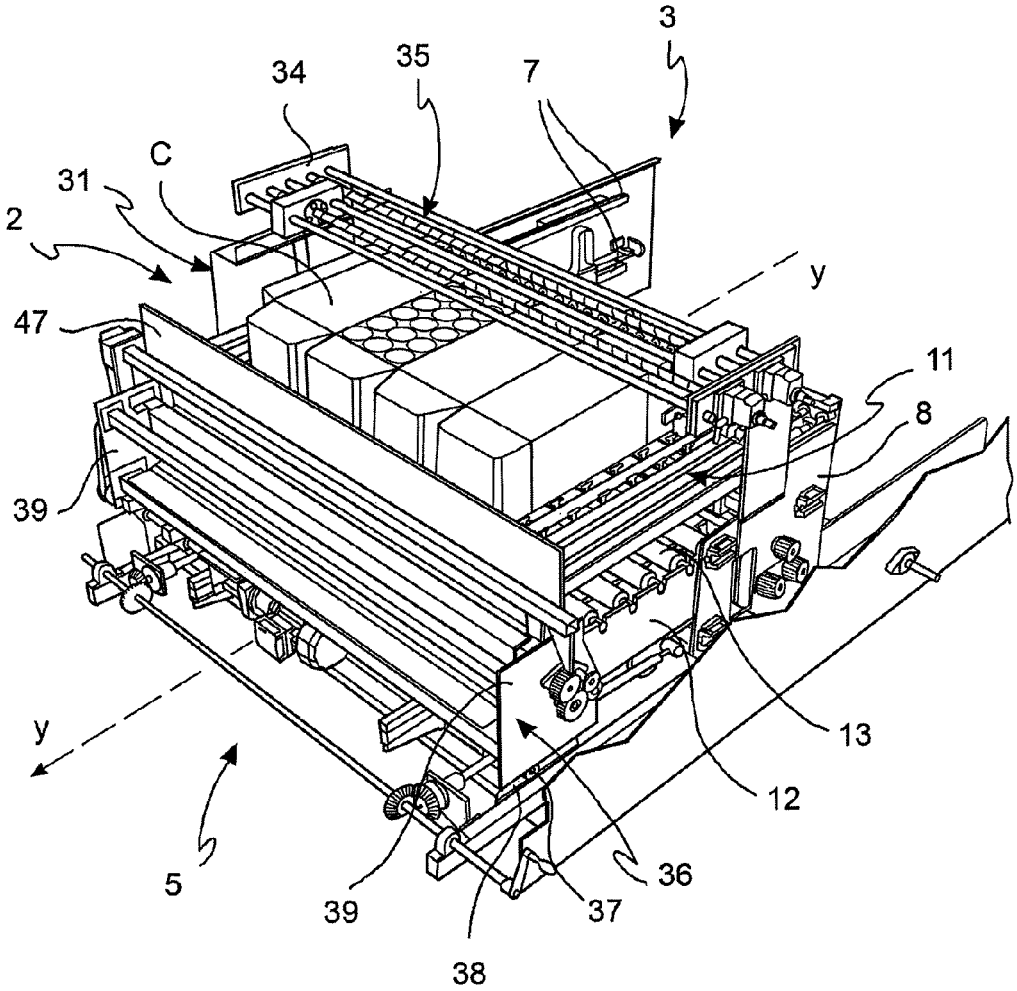
Figure 5C:
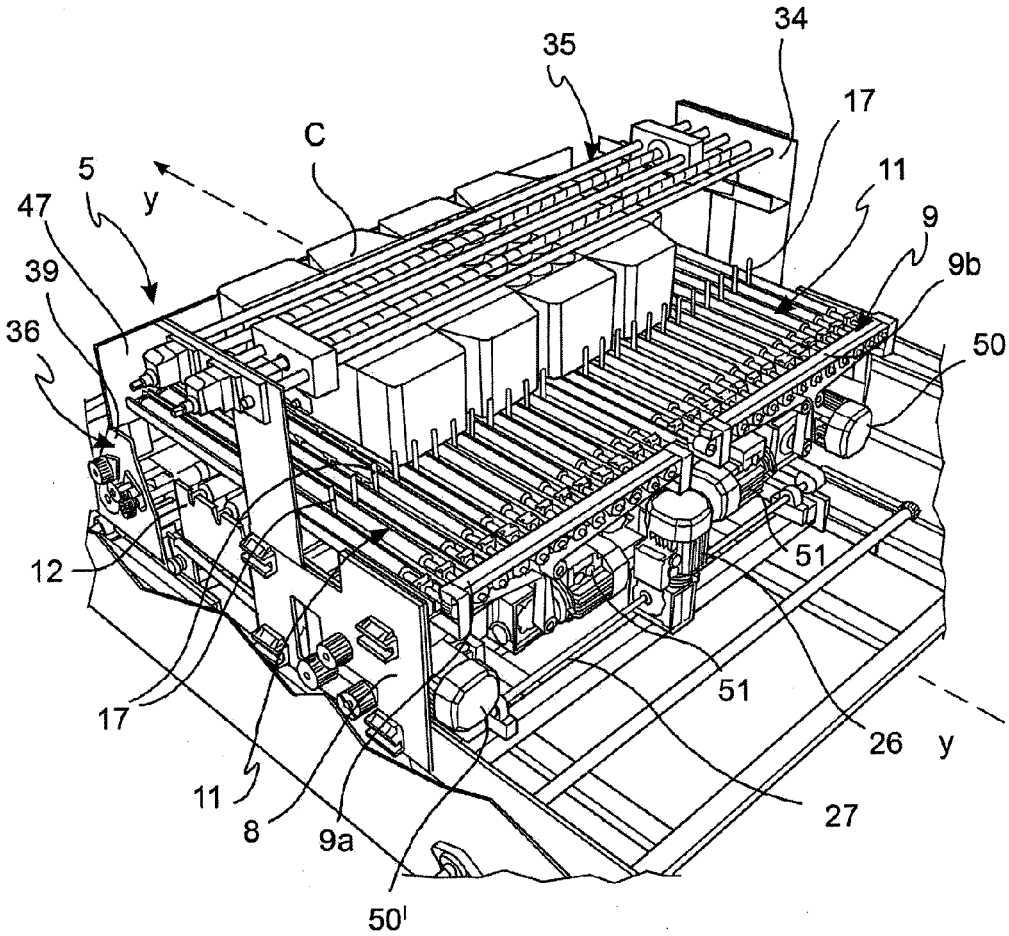

The loading step of the stack of cartons C is shown in the FIGS. 5A, 5B, and 5C.

A stack of cartons C is provided on the fork member 11 of the handling station 3 (FIG. 5A). At this point, the handling station 3 is actuated, so as to bring the stack of cartons above the warehouse 4 (FIG. 5B). The separator 16 is brought to its lifted position, in such a manner that the teeth 17 are inserted between the gaps S of the rods 10 and emerge above them. At the same time, or in an immediately preceding or successive moment, also the lifting member 14 is brought to its lifted position, in such a manner as to support the stack of cartons C by disengaging it from the fork member 11 (see in this regard FIG. 1A). Finally, the fork member 11 is retracted to its initial rest position and the lifting member 14 is brought again to the retracted position, allowing the stack of cartons C resting on the rolls 13. The teeth 17 of the separator 16 avoid that the stack of cartons C is retracted together with the fork member 11, and at the same time they level the cartons of the stack.

At this point, the step of separating into sheets may begin, as shown in the FIGS. 3A, 3B, and 3C. The sucker means 18 are brought to the lifted position up to almost contacting the lower surface of the lowermost carton C of the stack, and at the same time the suction is actuated. The carton is singularized by the stack (FIG. 3A). In an immediately successive moment, the sucker means 18 go down, bringing the edge of the withdrawn carton C below the wedge-shaped profile 45. With a synchronized movement, the gripping station 5, and thus also the wedge-shaped profile 45, is brought towards the warehouse 4. The suctioning by the sucker means 18 is stopped, such as to release the carton C (FIG. 3B). In this manner, the edge of the withdrawn carton is arranged below the wedge-shaped profile 45 until being gripped by the motorized rolls 41, 42, which bring it along the support surface 46 exiting the machine 1 (FIG. 3C). The holding edge 47 avoids that other cartons beside the withdrawn one are dragged forward.

In the embodiment shown in the figures, the synchronized movement is obtained by virtue of the fact that the crank mechanisms 25, 40 that move the sucker means 18 and the cart 36 are pivoted on the same pulley. In other cases, it will be possible to obtain a synchronization in a different manner, for example, by controlling by a driving and control unit the actuators of the sucker means 18 and the cart 36.

The second sucker means 18', if present, act in the same manner and are used with cartons of large dimensions.

Figure 4:
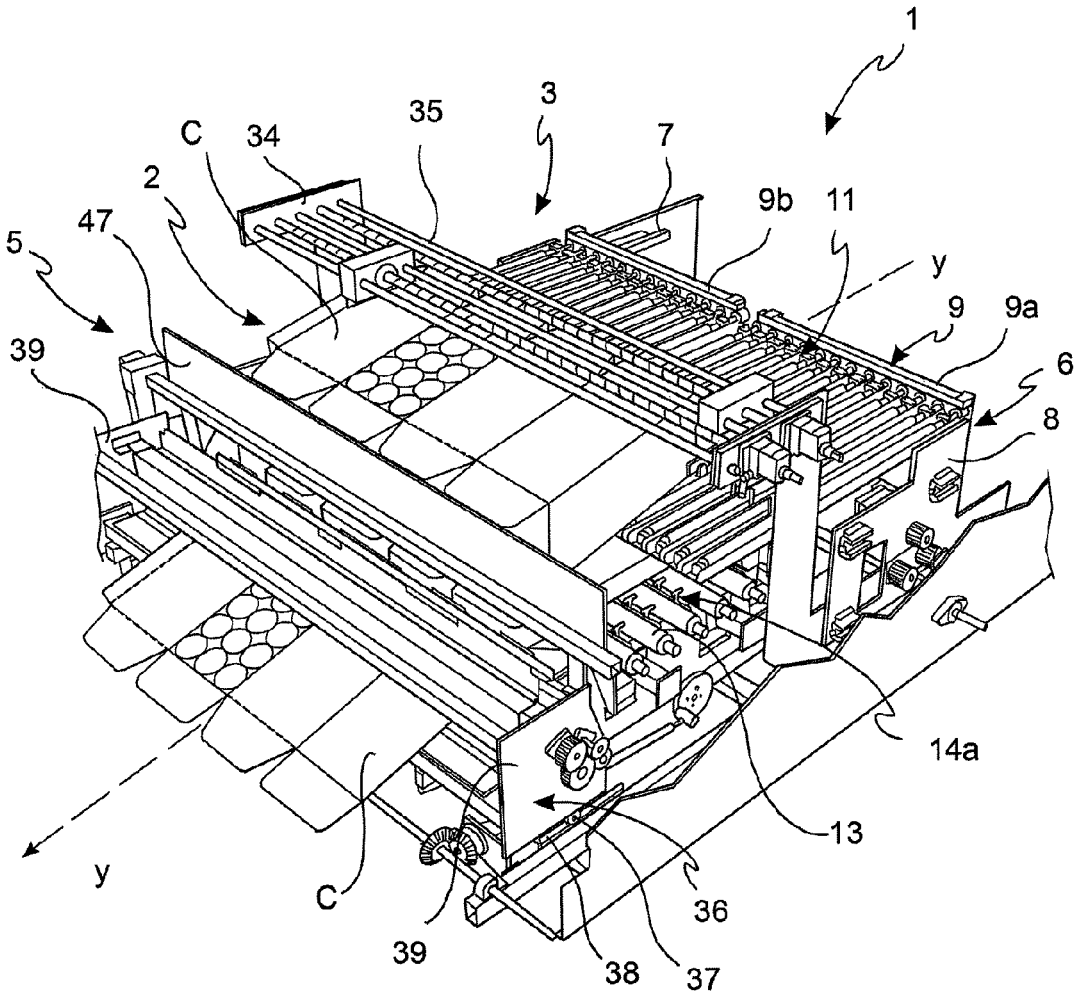
FIG. 4 represents a perspective view of the machine of FIG. 1 in the operative step of topping up the cartons.

The step of topping up the cartons is illustrated in FIG. 4. When the stack of cartons C is thinned, it is possible to add a new stack of cartons by substantially repeating the same operations described above for the loading step, without having to stop the process of separation into sheets. However, in such case, the lifting member 14 will not be actuated.

To this aim, the machine for separating into sheets will comprise sensors, for example photocells, arranged in a suitable position such as to detect when the level of the cartons C in the warehouse is dropped below a preset level. This datum is sent to a driving and control unit that then provides to start the topping up step.

The step of emptying the warehouse 4 to change the type of cartons C is performed by inverting the operative steps described above to load cartons, i.e.:

engaging the stack of cartons by the lifting member 14 advancing of the fork member 11 to below the stack of cartons disengaging the cartons by the lifting member 14 retracting the fork member 11 to the initial position.

From what has been set forth above, the advantages of the machine of the invention are many.

The machine allows singularizing the carton to be withdrawn in an efficient manner, independently from the type of cartons to be separated into sheets (smooth or rough surface), avoiding to drag two or more cartons at a time, which would cause a malfunctioning or a discontinuation of the packaging process downstream of the sheet separator machine.

The step of separating into sheets occurs in a quick and accurate manner, increasing the productivity of the packaging process.

The steps of loading, unloading, and topping up of the warehouse 4 occur in an accurate and automatized manner, without requiring interruptions in the machine operation.

It shall be apparent that only some particular embodiments of the present invention have been described, to which those skilled in the art will be able to make all those modifications necessary to fit thereof to particular applications, without for this departing from the protection scope as defined in the appended claims.

What we claim is:

1. A machine for separating sheets of cartons, comprising a frame on which a handling station of the cartons, a warehouse for at least one stack of cartons, and a gripping station of the cartons are mounted, in an operatively contiguous position, in which the gripping station comprises a pair of motorized counter-rotating rolls, suitable to withdraw a carton from said at least one stack of cartons, the machine comprising singularization means of a carton from said at least one stack of cartons, wherein said singularization means are arranged at the warehouse and comprise sucker means for gripping a carton from below from said at least one stack of cartons, the said sucker means comprising first sucker means in a position adjacent to said pair of motorized rolls, and optionally second sucker means, said sucker means comprising a support bar on which a plurality of suction bells is secured.

2. The machine according to claim 1, comprising singularization means of a carton from said at least one stack of cartons.

3. The machine according to claim 2, wherein said singularization means of a carton are arranged at the warehouse and comprise sucker means for gripping a carton from below from said at least one stack of cartons.

4. The machine according to claim 3, wherein the sucker means are mobile between a non-operative lowered position and a lifted position for suctioning a carton.

5. The machine according to claim 2, wherein the singularization means of the cartons and the cart of the gripping station of the cartons are connected, through corresponding crank mechanisms, to the same motorization.

6. The machine according to claim 1, wherein the pair of motorized rolls is mounted on a cart mobile longitudinally with alternated motion approaching to and moving away from the warehouse.

7. The machine according to claim 1, wherein the handling station comprises a cart, comprising at least one fork member on which a plurality of rods is mounted, said rods being spaced apart from one another by a space and having a width, said cart being mobile moving away from or approaching to the warehouse, so as to bring said rods above the warehouse.

8. The machine according to claim 1, wherein the warehouse comprises a plurality of rolls mounted idle and arranged transversally to the gripping direction of the cartons, such as to form a supporting and sliding surface for the stack of cartons, and optionally comprising one or more motorized rolls, such as to translate the cartons towards the gripping station.

9. The machine according to claim 8, wherein said rolls are spaced apart, and wherein below the warehouse a lifting member is arranged for said at least one stack of cartons, the lifting member comprising a plurality of bars arranged parallel to the rolls, but offset with respect to both the rolls and the rods of said at least one fork member, such as to take a position or move to be located below the gaps between a roll, and the contiguous one, and between a rod and the contiguous one when the at least one fork member is located above the warehouse.

10. The machine according to claim 1, wherein a separator is located between the handling station and the warehouse, said separator comprising a plurality of teeth facing upwardly and mutually spaced apart by a gap, the width of which is larger than the width of the rods of the at least one fork member, and wherein the width of the teeth is less than the gap between said rods, and wherein the separator is mobile between a retracted position and an extended position, wherein the teeth are inserted between the gaps of the rods and are lifted above said rods.

11. The machine according to claim 1, wherein, above the rolls and flush with the bottom of the at least one stack cartons in the warehouse, a separator wedge is located.

12. The machine according to claim 11, wherein the separator wedge is composed of a horizontal plate folded downwardly backward so as to create a rounded wedge-shaped profile above the first roll.

13. The machine according to claim 1, wherein a support surface for the carton that is separated is arranged downstream of said pair of rolls, said support surface ending at transport means for sending the carton separated into sheets towards a packaging machine.

14. The machine according to claim 1, wherein the gripping station of the cartons comprises a holding edge for holding and leveling the at least one stack of cartons in the warehouse, said holding edge being located on the upper portion of the side of the gripping station facing the warehouse.

15. The machine according to claim 1, comprising two fork members for loading two stacks of cartons in the warehouse, wherein a carton from each of said two stacks is gripped simultaneously by said gripping station.

16. A method for separating sheets of cartons from at least one stack of cartons, comprising the following steps:

a) providing a machine according to claim 1;

b) a loading step of the at least one stack of cartons in the warehouse, c) a step of separating the cartons into sheets, d) a step of topping up the cartons in the warehouse, and e) optionally, a step of unloading the cartons left in the warehouse.

17. The method according to claim 16, wherein the loading step b) comprises the following steps:

1) positioning a stack of cartons on said at least one fork member of the handling station;

2) actuating the handling station so as to bring the stack of cartons above the warehouse;

3) bringing the separator to its lifted position, in such a manner that the teeth are inserted between the gaps of the rods and emerge above them;

4) at the same time, or in an immediately preceding or successive moment, bringing the lifting member to its lifted position, in such a manner as to support the stack of cartons by disengaging it from the fork member;

5) retracting the fork member to its initial rest position and bringing the lifting member back to the retracted position, allowing the stack of cartons resting on the rolls of the warehouse.

18. The method according to claim 16, wherein the step of separating into sheets comprises the following steps:

6) bringing the sucker means to the lifted position up to almost contacting the lower surface of the lowermost carton of the stack, and at the same time actuating the suctioning so as to singularize a carton from the stack;

7) lowering the sucker means so as to bring the edge of the singularized carton below the separator wedge;

8) bringing, with a synchronized movement, the gripping station towards the warehouse and stopping the suctioning of the sucker means, such as to release the carton;

9) withdrawing the edge of the carton by means of the motorized rolls.

19. The method according to claim 16, wherein the step d) of topping up comprises repeating the steps 1)-5) of the loading step b).

20. The method according to claim 16, wherein said step e) of emptying the warehouse comprises the following steps:

i) positioning a stack of cartons on said at least one fork member of the handling station;

ii) actuating the handling station so as to bring the stack of cartons above the warehouse;

iii) bringing the separator to its lifted position, in such a manner that the teeth are inserted between the gaps of the rods and emerge above them;

iv) retracting the fork member to its initial rest position and bringing the lifting member back to the retracted position, allowing the stack of cartons resting on the cartons already present in the warehouse.

* * * * *